United States Patent [19]

Larkin

[11] 4,044,818

[45] Aug. 30, 1977

[54] APPARATUS FOR FORMING SAND MOLDS

[76] Inventor: Sam Larkin, 254 Beach 140th St., Belle Harbor, N.Y. 11694

[21] Appl. No.: 674,131

[22] Filed: Apr. 6, 1976

[51] Int. Cl.[2] ..... B22C 15/08; B22C 15/24; B22C 11/04

[52] U.S. Cl. ..... 164/172; 164/181; 164/183; 164/201; 164/210; 164/213

[58] Field of Search ..... 164/18, 22, 29, 30, 164/37, 169, 172, 173, 181, 183, 200, 201, 210, 213, 243

[56] References Cited

U.S. PATENT DOCUMENTS

| | | | |
|---|---|---|---|
| 3,417,811 | 12/1968 | Masi | 164/243 X |
| 3,630,268 | 12/1971 | Hatch | 164/183 X |
| 3,858,639 | 1/1975 | Larkin | 164/30 X |
| 3,955,614 | 5/1976 | Geiger | 164/210 |
| Re. 28,735 | 3/1976 | Lund et al. | 164/200 X |

*Primary Examiner*—Ronald J. Shore
*Attorney, Agent, or Firm*—Friedman, Goodman & Teitelbaum

[57] ABSTRACT

Automatic sand mold fabricating apparatus and a method for using the apparatus is disclosed. The present invention provides at least a first cope and a first drag. Preferably, first and second copes and first and second drags are used. Where two pairs of copes and drags are utilized, the first pair will be filled at two diametrically opposed stations while the other pair will be positioned at one of two ejection stations that are both 90° spaced apart from the first and second stations. The pairs of copes and drags alternate between the filling stations that are diametrically opposed to each other and the ejection stations which are 90° away. A mechanism is also provided for selectively inserting a core at either one or both of the ejection stations, and a mechanism for selectively inverting the impression forming member to thereby permit two concurrently operating discharge conveyors for the finished sand molds and to also permit differently shaped molds to be formed without interrupting the sand casting mold fabrication procedure. A feature of the present invention is that each of the drags is inverted during its travel from its loading or filling station to either of the two ejected stations.

31 Claims, 12 Drawing Figures

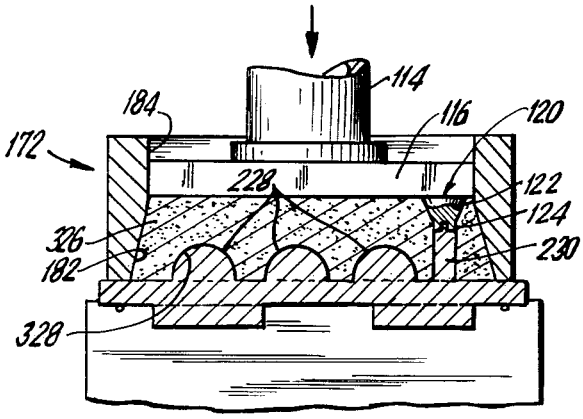
FIG. 7
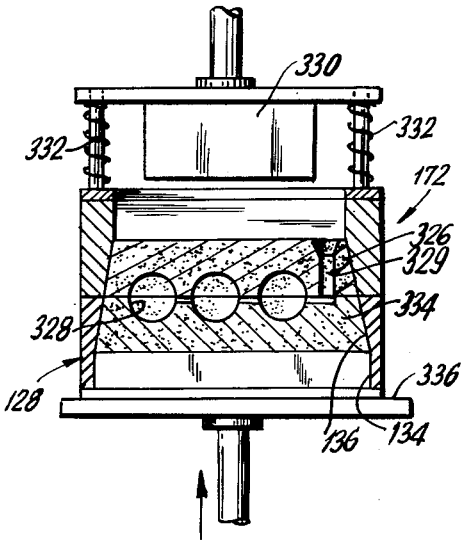
FIG. 8
FIG. 9
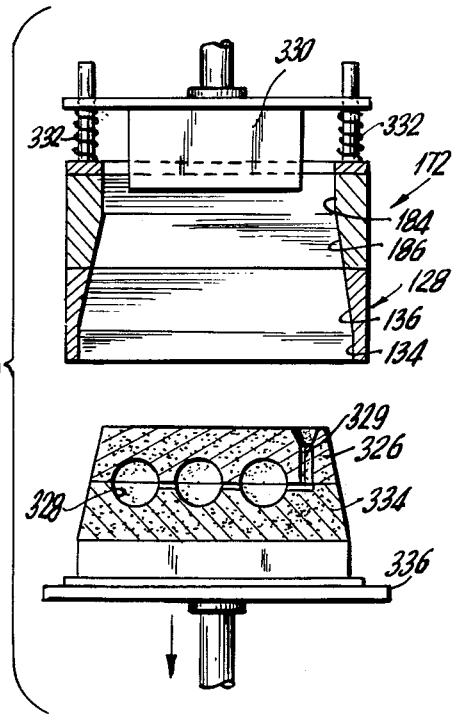
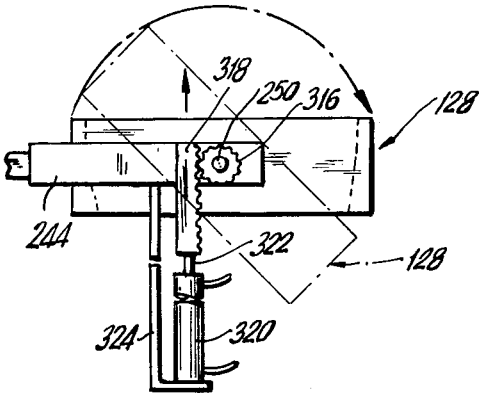
FIG. 10
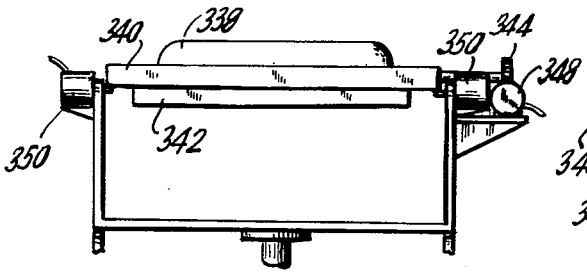
FIG. 11
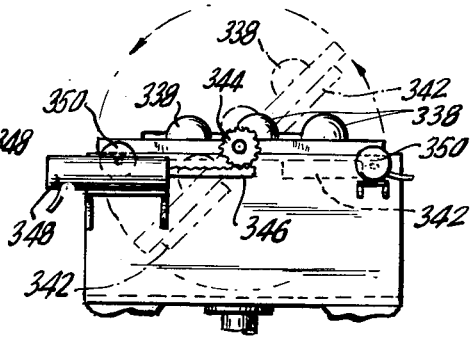
FIG. 12

APPARATUS FOR FORMING SAND MOLDS

BACKGROUND OF THE INVENTION

The present invention relates generally to the casting arts and more particularly to a method and apparatus for automatically forming sand molds.

Sand molds are usually formed of a lower or drag section and a mating, cooperating upper or cope section. Each of the two sections have cooperating impressions formed therein by means of a model or master so that molten metal can be poured between the two sections and into the impressions and subsequently cooled in order to assume the configuration corresponding to the impressions in the opposing, cooperating sand mold sections. In the past this procedure has been carried out manually and, as such, was time consuming. Clearly, manual operations do not lend themselves to and are not suitable for present day high speed industrial requirements.

Sand mold formation machines have been developed wherein sand has been deposited in an enclosure and wherein opposing pattern plates are displaced towards one another into the enclosure in order to compact the sand. The pattern plates impart, on opposite faces of the sand, an impression corresponding to the impression in the pattern plates. After removing or retracting the pattern plates from the enclosure, ejectors are used for displacing the mold sections that have been formed in the enclosure. The ejected mold section is provided with two opposing faces which, if disposed opposite another mold section formed in the manner described, can be used for cooperatively receiving molten metal which fills the cavity defined by the opposing faces. When the molten metal is cooled, it can be removed from the mold sections and any subsequent finishing operations can be then performed. A plurality of the mold sections can be placed side by side to thereby permit the continuous pouring of molten metal into the mold sections.

One machine that is conventional and which is known in the art provides means for rapidly forming the mold by means of a bed that can be reciprocated between two positions. After the mold is formed in a first enclosure by opposing pattern plates, the bed is shifted to a second position after the pattern plates have been retracted in order to permit a first ejector to enter the first enclosure and eject the mold formed therein. While the ejector is displacing the formed mold from the first enclosure, a second mold is being formed by the pattern plates in a second enclosure. After the first mold is ejected from the first enclosure, the first ejector is retracted, together with the opposing pattern plates which have operated upon the second enclosure to form the second mold, the bed is then shifted or reciprocated in the opposite direction in order to align the second enclosure with a second ejector that is on the opposite side of the pattern plates. The second ejector enters the second enclosure and ejects the second mold which is then directed to a second station. During the ejection of the second mold, a third mold is being formed in the first enclosure and again the bed is reciprocated to the first ejector position. This procedure is repeated continuously. In order to provide a great number of sand mold portions, the sand mold portions are positioned opposite one another in two parallel, linear arrays which can be further operated upon independently.

While the prior art apparatus just described does represent a substantial improvement over manual operations, it still does exhibit several disadvantages. That is, the sand receiving enclosure cannot be readily adjusted for releasing the formed sand mold sections. Therefore, since the sand when compacted adheres to the surfaces of the enclosure, it is very difficult to eject the formed sand mold sections without causing damage thereto. Another disadvantage of the prior art machine previously described resides in the contact of the face of the ejector with portions of the impressions that have been formed in the sand. Since the weight of the mold is heavy, it is necessary for the ejector to exert large forces against the sand in the mold in which the impressions have been formed. Therefore, it is not uncommon for the ejector to damage the impression. Even where means are provided for preventing the ejector from contacting the impression area in the sand it is impossible for the ejector to exert a uniform pressure against the entire surface of the mold sections. Thus, there is a likelihood of distortions of the mold section as it is displaced by the ejector.

Still another disadvantage of the conventional prior art machine described above is the absence of provisions for rapidly replacing the patterns in order to permit the formation of mold sections having different impressions. In any production run, the mold sections will have identical patterns. However, when it is necessary to change over to another run where different impressions are required, it is very difficult with the prior art apparatus to change the pattern plates of the machine.

Another form of prior art apparatus for forming sand molds is disclosed in my issued U.S. Pat. No. 3,744,550 granted on July 10, 1973. In my issued patent there is disclosed apparatus which includes an elongated bed having adjacent and partially enclosed receptacles for alternately receiving sand. A top cover plate is used for partially further enclosing the receptacles in an alternating pattern. The top cover plate is operatively associated with the receptacles for alternately adjusting the configuration of the receptacles from the configuration for operating on the sand disposed therein to form a mold to that configuration for releasing the mold so formed therein. A pair of opposing cooperating pattern plates are shiftably supported for entering together into each of the receptacles respectively, in opposing relation, to compact the sand disposed in the receptacles. A pair of mold ejectors are also utilized for entering the receptacles alternately and for ejecting the mold formed in the receptacles. The elongated bed is capable of reciprocating in a longitudinal direction over a plurality of selected positions such that the pattern plate and the ejectors can be aligned properly opposite selected ones of the receptacles alternately in operative association with the receptacles. The ejectors utilize pressurized fluid to aid in the ejection process and the pattern plates are each provided as a group of at least two patterns that may be reciprocated vertically in order to effect a change in the type of patterns utilized.

While my issued U.S. patent represents a substantial improvement over the apparatus previously available, it has been found that still other improvements can be made.

SUMMARY OF THE INVENTION

Accordingly, it is an object of the present invention to provide a fully automated apparatus for sequentially forming a plurality of sand molds quickly and reliably.

It is a further object of the present invention to provide an improved method for automatically forming a plurality of sand molds.

These objects are achieved by the sand mold fabricating apparatus of the present invention. The present invention provides at least a first cope and a first drag. Preferably, first and second copes and first and second drags are used. Where two pairs of copes and drags are utilized, the first pair will be filled at two diametrically opposed stations while the other pair will be positioned at one of two ejection stations that are both 90° spaced apart from the first and second stations. The pairs of copes and drags alternate between the filling stations that are diametrically opposed to each other and the ejection stations which are 90° away. Means are also provided by the present invention for selectively inserting a core at either one or both of the ejection stations and means for selectively inverting the impression forming means to thereby permit two concurrently operating discharge conveyors for the finished sand molds and to also permit differently shaped molds to be formed without interrupting the sand casting mold fabrication procedure. A feature of the present invention is that each of the drags is inverted during its travel from its loading or filling station to either of the two ejection stations.

BRIEF DESCRIPTION OF THE DRAWINGS

With the above and additional objects and advantages in view as will hereinafter appear, this invention comprises the devices, combinations and arrangements of parts hereinafter described and illustrated in the accompanying drawings of the preferred embodiment in which:

FIG. 7 is an elevational view, partially in section, illustrating one step in the method for forming the sand mold sections;

FIG. 8 is an elevational view, partially in section, illustrating another step in the formation of the sand mold sections;

FIG. 9 is an elevational view, partially in section, illustrating still a further step in the formation of the sand mold sections;

FIG. 10 is an elevational view illustrating a feature of the present invention;

FIG. 11 is an elevational view illustrating an alternative embodiment of the present invention; and FIG. 12 is an elevational view illustrating the mode of operation of the embodiment shown in FIG. 11.

DETAILED DESCRIPTION OF THE INVENTION

Figure 1:
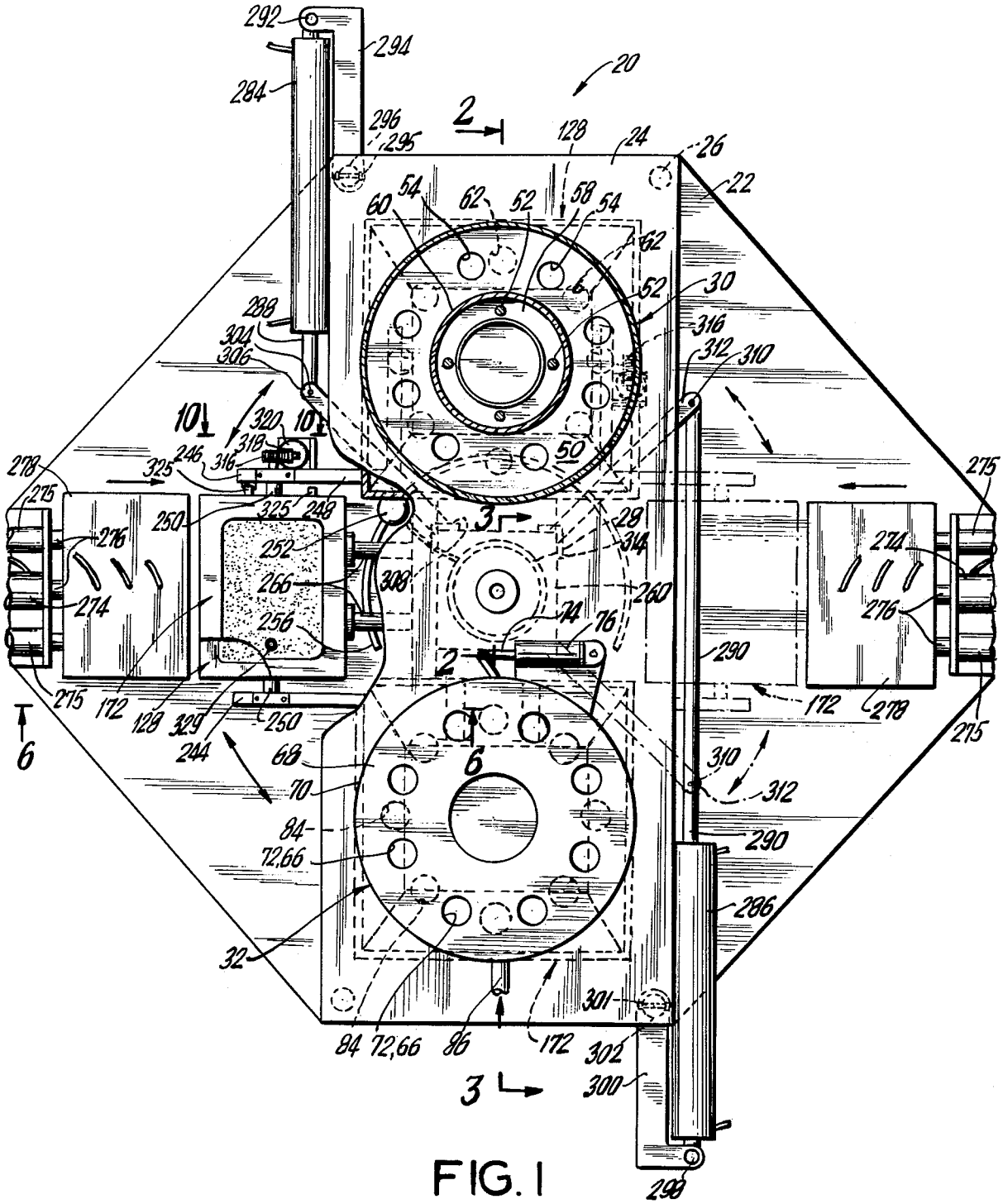
FIG. 1 is a top plan view, partially in section and partially in phantom outline illustrating an alternative position of several of the components therein.
Figure 2:
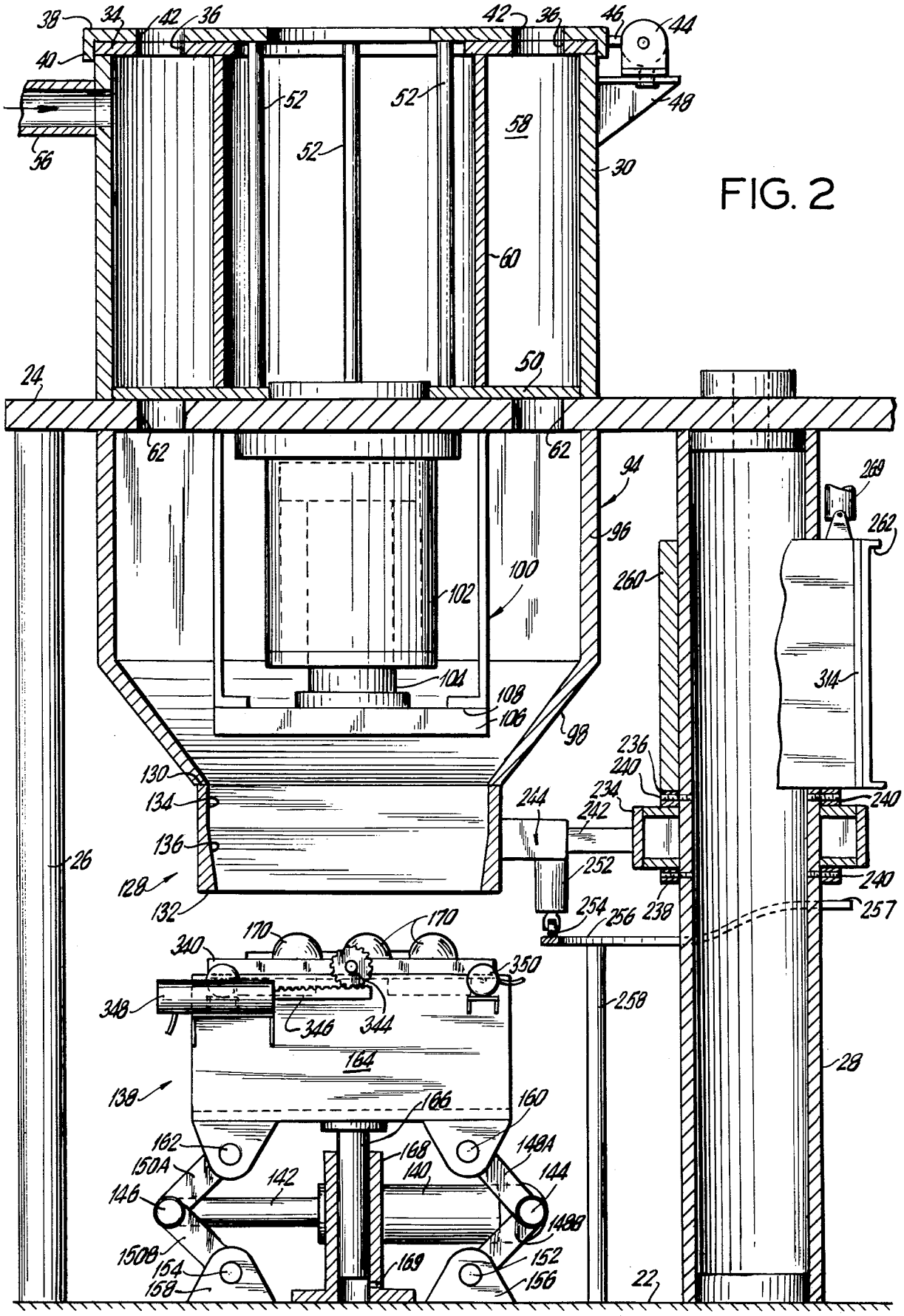
FIG. 2 is a side elevational view on an enlarged scale, partially broken away and partially in section, taken along line 2—2 of FIG. 1, showing the mechanism before the sand is inserted.
Figure 3:
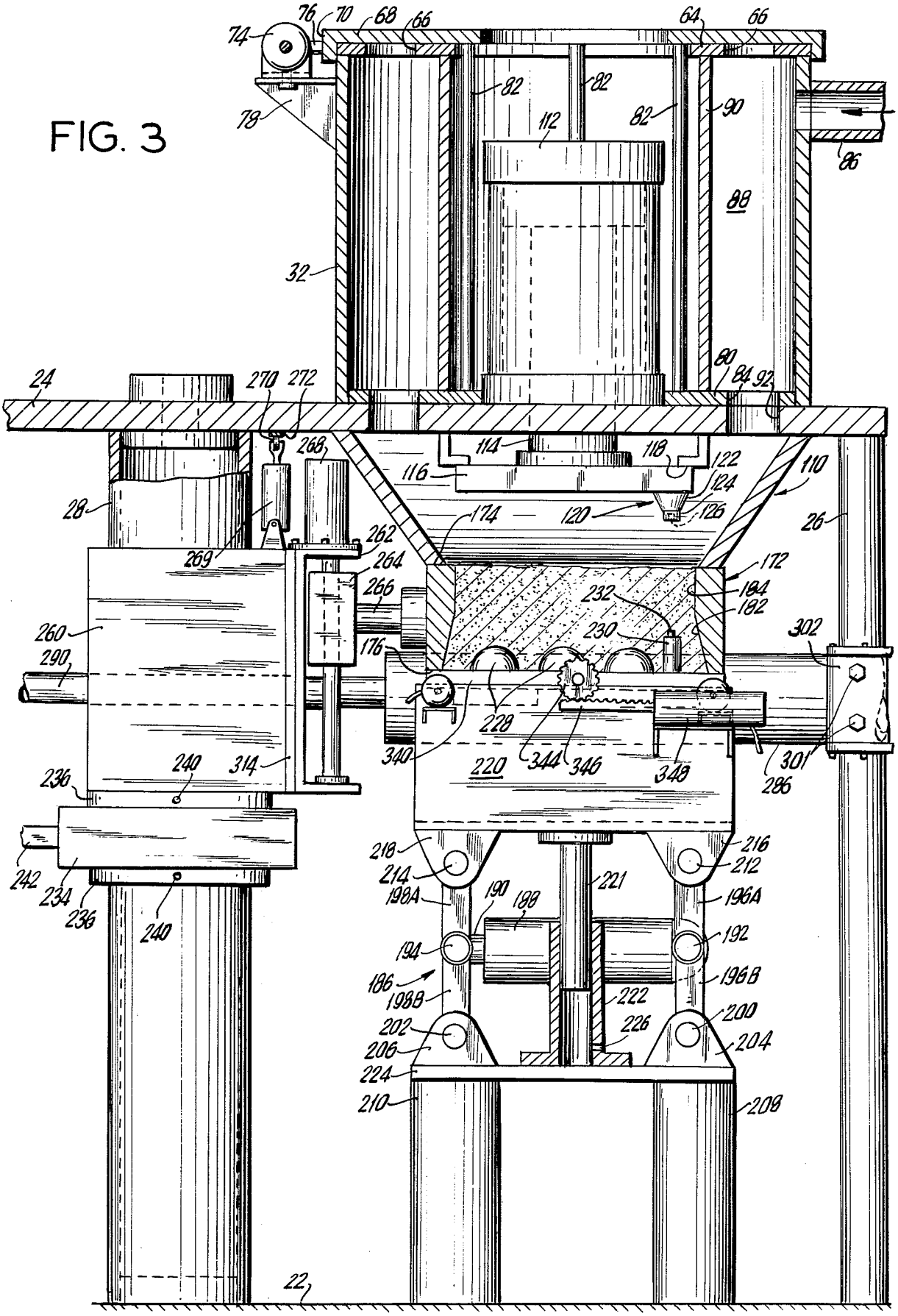
FIG. 3 is a side elevational view on an enlarged scale, partially in section and partially broken away, taken along line 3—3 of FIG. 1, showing the mechanism after the sand has been inserted.

Referring now to the drawing and in particular to FIGS. 1, 2 and 3, there is shown the improved apparatus 20 comprising the present invention for forming sand molds. The apparatus 20 includes a base plate 22 and a top plate 24 that is spaced from the baseplate 22 by means of a plurality of posts 26. A hollow tube 28 extends between the base plate 22 and the top plate 24 and is centrally located. The hollow tube 28 may be used as a central air supply for the various actuating means or drive assembly to be described hereinafter. A pair of elongated, cylindrical housings 30 and 32 are secured to the upper surface of the top plate 24 on opposite sides of a center line running from right to left and through the tube 28 as shown in FIG. 1.

The housing 30 is comprised of a first, fixed top wall or closure member 34 having a plurality of angularly spaced apart openings 36 formed therein. A second closure member or cover 38 having a downwardly turned peripheral lip 40 that engages the cicumferential outer surface of the housing 30 rests on top of the closure member 34 and is provided with a plurality of angularly spaced apart openings 42 that are the same pitch circle as the openings 36. The cover 38 is adapted to be angularly reciprocated by means of an hydraulic or pneumatic cylinder 44 having a piston 46 that is rigidly secured to the cover 38. The cylinder 44 is mounted on a bracket 48 which is rigidly, secured to the housing 30.

The cover 38 is coupled to a first bottom plate or closure member 50 by means of a plurality of posts 52. The bottom plate 50, as shown in FIG. 1, is provided with a plurality of angularly spaced apart openings 54 therethrough. An inlet means in the form of a pipe 56 provides communication between a source of pressurized fluid, for example air, and the interior of the housing 30. When the openings 36 and 42 in the top wall 34 and the cover plate 38, respectively, are in alignment, as shown in FIG. 2, sand can be introduced therethrough so that the sand passes into and through the annular chamber 58 defined between the interior surface of the housing 30 and the exterior surface of a concentric internal sleeve 60 that is coupled to and extends between the top wall 34 and the bottom plate 50. When a sufficient quantity of sand has accumulated in the annular chamber 58, the top wall 38 is angularly displaced by the cylinder 44 and the piston 46 so that the openings 36 and 42 in the top wall 34 and the cover 38, respectively are misaligned, such as the openings 54 and 62 shown in FIG. 1. At this time, the bottom 54 has been angularly displaced so that the bottom plate 50 will be in alignment with a plurality of angularly spaced apart openings 62 that are formed through the top plate 24 on a pitch circle that is the same size as the openings 36 and 42. When the opening 62 and 54 are in alignment, air is forced through the pipe 56 in order to facilitate the downward flow of the sand through the openings 62 and 54.

The housing 32 is also provided with a rigidly connected top wall 64 through which is formed a plurality of angularly spaced apart openings 66. A cover 68 having a downwardly extending peripheral lip 70 that engages the outer surface of the housing 32 is positioned over the top wall 64 and is provided with a plurality of openings 72 therethrough such as shown in FIG. 1. The openings 72 in the cover 68 are on the same pitch circle as the openings 66 in the top plate 64. A cylinder 74 having a piston 76 is used for angularly reciprocating the cover 68 in the same manner as the cylinder 44 reciprocates the cover 38. The cylinder 74 is rigidly secured to the housing 32 by means of a bracket 78. The housing 32 is also provided with a bottom wall that is coupled to the cover 68 by means of a plurality of posts 82. A plurality of angularly spaced apart openings 84 are formed through the bottom wall 80 and are on the same pitch circle as the openings 66 in the top plate 64. A pipe 86 provides communication between a remote source of pressurized fluid, for example air, and an annular chamber 88 that is defined by the inside surface of the housing 32 and the outside surface of a concentric, internal sleeve 90 that extends between the upper plate 64 and the bottom plate 84. The sleeve 90 is rigidly coupled to the top plate 64.

When the openings 66 and 72 in the top plate 64 and the cover 68, respectively, are in alignment as shown in FIG. 1, sand can be introduced therethrough into the annular chamber 88. When a sufficient quantity of sand is so positioned, the piston 74 and the cylinder 76 angularly displace the cover 68 so as to place the opening 66 and 72 out of alignment with each other as shown in FIG. 3, and thereby close the upper end of the housing 32. Air under pressure may then be introduced to the pipe 86 into the annular chamber 88 so that the sand may flow through the openings 84 and a plurality of openings 92 that are formed in the top plate 24. It should be noted that the openings 92 in the top plate 24 are on the same pitch circle as the openings 84 in the bottom plate 80 so that when the openings 66 in the top plate 64 are covered such as shown in FIG. 3, the openings 84 and 92 will be in alignment such as shown in FIG. 3. It should also be noted that, in the same manner as the structure shown in FIG. 2, when the openings 66 and 72 are in alignment, the openings 84 and 92 will be out of alignment.

It should be further noted that the mechanisms shown in FIGS. 2 and 3 function together at the same time, so that the top openings 36 and 42 are in alignment when the top openings 66 and 72 are in alignment. Accordingly, FIG. 2 shows the housing 30 before the sand has been inserted, and FIG. 3 shows the housing 32 after the sand has passed through, by way of the illustration only, where the sand is actually provided to each housing at the same time, and the cylinders 44 and 74 function together so that the sand passes through the housings 30, 32 also at the same time.

As shown in FIG. 2, a funnel 94 is secured to the underside of the top plate 24 and is arranged to receive the sand as it flows through the aligned holes 54 and 62 from the annular chamber 58. The funnel 94 has a straight side wall 96 and an inwardly tapered section 98 at the lower end thereof. A vertically reciprocable ram assembly, generally designated by the reference character 100 is mounted within the funnel 94 and is actuated from a remote pressure source in a manner to be described more fully hereinafter. The ram assembly 100 is comprised of a cylinder 102 having a piston 104 to which is secured a platen 106. Upward movement of the piston 104 and the platen 106 is limited by stop means 108 which are secured to the underside of the housing connected to the top plate 24.

Similarly, as shown in FIG. 3, a funnel 110 is secured to the underside of the top plate 24 in communication with the aligned openings 92 and 84 and the annular chamber 88. The funnel 110 consists of four inwardly tapered walls. A cylinder 112 having a piston 114 is provided with a platen 116 whose upward movement is limited by stop means 118 which are secured to the underside of the top plate 24. For purposes to be described more fully hereinafter, the platen 116 is provided with a plug 120 having a conical portion 122 and a cylindrical portion 124 in which a recess 126 is formed.

In a manner to be described more fully hereinafter, a drag 128 is positioned below the open, bottom end of the tapered portion 98 of the funnel 94. The drag 128 as shown in FIG. 2 is inverted from the position it will assume at subsequent time (and is also angularly displaceable in a manner to be described more fully hereinafter) so that the bottom surface 130 thereof appears at the top and the top surface 132 thereof appears at the bottom. Proximate the bottom surface 130 of the drag 128, the inside wall surface 134 thereof is straight while the wall surface 136 proximate the top surface of the drag 128 is tapered in order to provide the required draft.

In spaced opposition to the surface 132 of the drag 128 there is provided an elevator-like member generally designated by the reference character 138. A cylinder 140 having a piston 142 is pivotally coupled at 144, 146, respectively to pairs of links 148A, 148B, and 150A, 150B, respectively. The links 148B and 150B are pivotally coupled at 152 and 154, respectively, to anchors 156 and 158, respectively. The links 148A and 150A are pivotally coupled at 160 and 162, respectively, to a mold forming member 164. A rod 166 extends downwardly from the mold forming member 164 and is slidably received in a guide tube 168 having a vent opening 169 therein in order to assure accurate vertical movement of the mold forming member 164. By way of example and without intending to be limiting, impression forming means 170 in the form of elongated hemispheres are provided on the top surface of the mold forming member 164. It will be appreciated that other types of impression forming members may also be employed. It should be further appreciated that means not shown are provided permitting the rapid removal and interchange of the impression forming means 170.

As shown in FIG. 3, a cope 172 is positioned directly beneath the bottom, open end of the funnel 110. Means for positioning the cope 172 as shown in FIG. 3 will be described hereinafter. The cope 172 includes a top surface 174 and a bottom surface 176. As will be explained more fully hereinafter, the cope 172 is axially movable (with respect to the longitudinal axis of the hollow, center tube 28) in addition to being angularly displaceable. As shown in FIG. 3, the cope 172 includes a tapered inside wall surface 182 proximate the bottom surface 176 thereof in order to provide the necessary draft. The cope 172 is also provided with a straight side wall portion 184 proximate the top surface 174 thereof.

Another elevator-like assembly, generally designated by the reference character 186, is provided beneath the cope 172 and comprises a cylinder 188 having a piston 190. The cylinder 188 and the piston 190 are pivoted at 192 and 194, respectively, through pairs of links 196A, 196B and 198a, 198B, respectively. The pair of links 196B and and 198B are pivoted at 200 and 202, respectively, to anchors 204 and 106, respectively, which are, in turn, mounted on posts 208 and 210, respectively. The links 196A and 198A are pivoted at 212 and 214, respectively, to brackets 216 and 218 which are integral with the bottom surface of a mold forming member 220. A post 221 extends downwardly from the bottom surface of the mold member 220 and is slidably guided within a sleeve 222 that is mounted on a plate 224 which spans the posts 208 and 210. A vent hole 226 is provided in the sleeve 222. A plurality of impression forming members 228 are provided on the upper surface of the mold forming member 220. In addition a plug 230 having a reduced diameter end portion 232 is provided on the upper surface of the mold forming member 220. The reduced diameter portion 232 of the plug 230 is in opposition to and is adapted to mate with the recess 126 formed in the member 120 in order to subsequently form a sprue hole.

At this time it should be noted that the apparatus comprising the preferred embodiment of the present invention includes to drags 128 and two copes 172. One drag 128 is positioned directly beneath the center of the housing 30 of FIG. 1 while one cope 172 is positioned directly beneath the housing 32 in FIG. 1. The other drag 128 and the other cope 172 are positioned on the same pitch circle but are 90° spaced apart from the first drag 128 and the first cope 172. That is, as seen in FIG. 1, the first drag 128 is at the 12 o'clock position and the first cope 172 is at the 6 o'clock position. The second drag 128 is at the 9 o'clock position and the second cope 172 is also at the 9 o'clock position. Since the means for supporting both drags 128 are the same and the means for supporting both copes 172 are the same, only one of each will be described hereinafter in each instance.

As shown in FIG. 2, a support member 234 is rotatably mounted on the post 28 and is retained at a particular height between upper and lower guide means 236 and 238 which are annular and which are secured to the post 28 by means of fasteners such as screws 240. Bars or brackets 242 are suitably secured to the support member 234 and extend outwardly therefrom. While only one bracket 242 is shown in FIG. 2 it should be understood that there are two more 90° spaced aprt brackets hich extends outwardly from the post 28. The other end of the central bracket 242 is secured to a V-shaped bracket 248 providing two arms or bars 246. Another arm or bar 244 is provided on the end of each of the other outer two brackets 242. One arm 244 and an associate one of the arms 246 are positioned on either side of each drag 128, one set being shown at the 9 o'clock position in FIG. 1, the other set of arms 244, 246 being in phantom at the 12 o'clock position. For purposes to be described hereafter, a pair of coaxial, spaced part pins 250, which extend inwardly from the two associated spaced apart arms 244, 246, pivotally support the drag 128. One switch 252 is associated with each drag, being connected to an associated bracket 242 and extends downwardly therefrom. The switch 252 for the drag at the 9 o'clock position is shown in FIG. 1, and the other switch 252 for the drag at the 12 o'clock position is shown in FIG. 2. Each cam follower 254 is in rolling engagement with an arcuate cam 256 which is supported on appropriate posts 258 as shown in FIG. 2. The cam 256 extends through an arc that is somewhat greater than 180° as may be seen in FIG. 1 and has raised portions 257 that closes each switch 252 when the cam follower 254 rides thereon, as will be explained hereinafter below.

The copes 172 are supported by a sleeve 260 which is rotatably mounted on the post 28 directly above the upper guide member 236. The sleeve 260 on the post 28 is provided with a U-shaped bracket 262 for each cope that slidably supports a block 264 on which is mounted a pair of rods 266, only one of which may be seen in FIG. 3. Each cope 172 is secured, in any suitable manner, to a pair of the rods 266. Cylinder means 268 provide the vertical displacement of the block 264. In addition, the sleeve 260 is provided with a switch 269 on the upper surface thereof for each cope, and a cam follower 270 is made integral with each switch 269. A cam surface 272, having one actuating section 273 (FIG. 5) is secured to the underside of the top plate 24 for each switch 269, and is engaged by the associated cam follower 270 so that the switch may be closed when the cam follower 270 reaches the actuating section 273. One section 273 is positioned at the 9 o'clock position of FIG. 1, and the other section 273 is positioned at the 3 o'clock position thereof.

Figure 4:
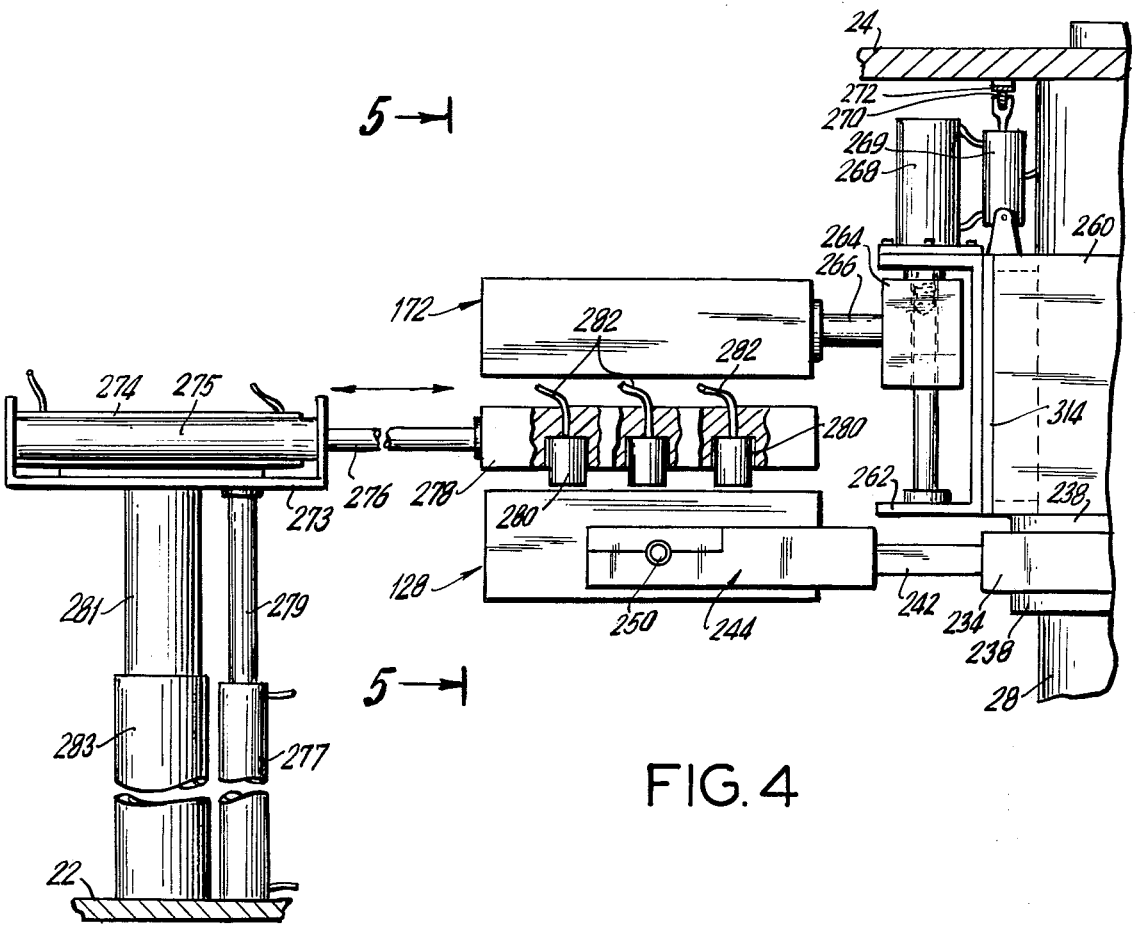
FIG. 4 is a fragmentary elevational view, partially in section and partially broken away, illustrating a feature of the present invention.
Figure 5:
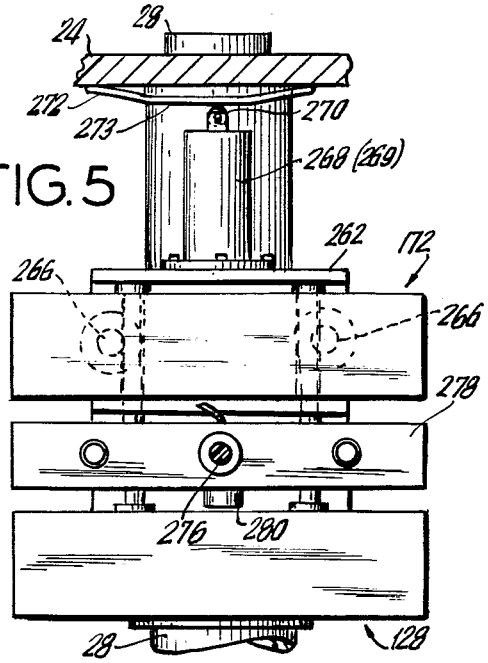
FIG. 5 is a fragmentary elevational view, partially in section taken alone line 5—5 of FIG. 4.
Figure 6:
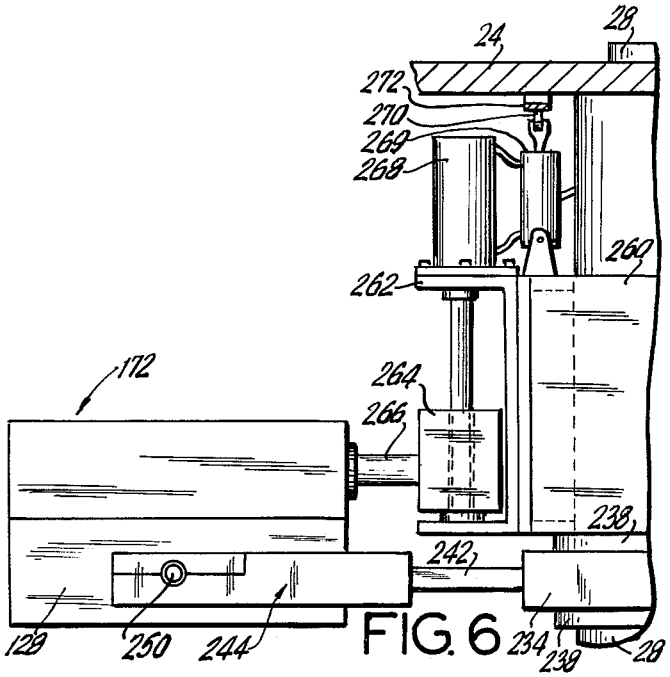
FIG. 6 is an elevational view, partially in section, taken along line 6—6 of FIG. 1.

Should it be desired to place an insert, such as a core in the impressions formed by the cooperating members 170 and 228, the structure illustrated in FIG. 4 and FIG. 5 may be utilized. At this point in time in the method comprising the present invention, the cope 172, having moved from the 6 o'clock position in FIG. 1 to the 9 o'clock position in FIG. 1, is spaced directly above the drag 128 which has moved, for example, from the 12 o'clock position in FIG. 1 to the 9 o'clock position in FIG. 1. An air operated cylinder 274 is mounted on a frame 273 and has a piston or rod 276 which carries a support member 278 in which are held, for purposes of illustration only, a plurality of cylindrical plugs or cores 280. Additional rods 276 are slidably disposed in cylinders 275 positioned on each side of the air cylinder 174 in order to further support the support member 278, as best shown in FIG. 1, at each of the ejection stations. Lines 282, which are in communication with a suitable vacuum source, hold the cores 280 in the support member 278 until such time as they are released into the impressions formed by the cooperating members 170 and 288. The cope 172 may then be moved downwardly to the position shown in FIG. 6.

In operation, the cores 280 are loaded into the support member 278 in the retracted position thereof shown in FIG. 1. The air cylinder 274 then moves the support member 278 into the extended position between the cope and drag as shown in FIGS. 4 and 5. Another conventionally operated air cylinder 277 is provided with a piston or rod 279 which is connected to the frame 273. The air cylinder 277 vertically lowers the frame 273 so that the support member 278 is positioned on the drag 128, with the cores 280 disposed in the impression of the drag. After the cores 280 are released, the air cylinder 277 raises the support member 278 and the air cylinder 274 return the support member 278 and the air cylinder 274 return the support member 278 to the retracted position. An additional rod 281 connected to the frame 273 is slidably disposed in a cylinder 283 mounted on the plate 22 in order to further support the frame 273. It is noted, that the above-mentioned core setting apparatus is activated only when it is necessary to position cores in the impressions.

In order to move the cope 172 and the drag 128 from station to station, a pair of opposed air operated cylinders 284 and 286 are employed, as best shown in FIG. 1. The cylinder 284 includes a piston 288 and the cylinder 286 includes a piston 290. The cylinder 284 is pivotally secured at 292 to one leg of an L-shaped bracket 294. The other leg of the bracket 294 is fixedly secured by bolts 295 at 296 to the post 26. Similarly, the cylinder 286 is pivoted at 298 to one leg of another L-shaped bracket 300 while the L-shaped bracket 300 is fixedly secured by bolts 301 at 302 to the post 26. The piston 288 is pivoted at 304 to one end of a link 306. The other end of the link 2306 is rigidly secured to a bracket 308 which is, in turn, integral with the member 260. Similarly, the piston 290 is pivoted at 310 to another link 312 whose opposite end is rigidly secured to a bracket 314 that is integral with the member 234. Thus, when the pistons 290 and 288 are selectively extended and retracted, the members 260, 234 and the drag 128 and the cope 172 connected thereto, respectively, will be reciprocatingly moved through an arc of 90°.

While each drag 128 is being moved between stations (between 12 o'clock and 3 o'clock, and between 9 o'clock and 12 o'clock as seen in FIG. 1) it is also being inverted. That is, it will be inverted 180° from the position shown in FIG. 2 to the position shown in FIG. 8 and then inverted back again after the sand mold is ejected. This is accomplished by means of the structure shown in FIGS. 1, 2 and 10. A pinion 316 is mounted on each pivot 250 and meshingly engages a rack 318 which is displaced linearly by means of an air cylinder 320 and a piston 322. One air cylinder 320 is mounted on a bracket 324 that is suitably secured to the arm 246 shown in FIG. 1, and the other air cylinder 320 is mounted on another bracket 324 that is secured to the arm 244 shown in FIG. 10, there being one for each drag. Each air cylinder 320 is activated by the switch 252 associated therewith cooperating with the cam 256, as the cam follower 254 rides on the cam between stations. Spaced apart abutment tabs 325, shown in FIG. 1 are positioned on the drag to engage a flange at the end of the arm 246 (244) to hold the drag in a horizontal position.

As shown in FIG. 7, the platen 116 compresses the sand 326 within the cope 172 about the impression forming members 228 and to the level of the sloping side walls 182 in order to subsequently permit easy ejection and automatically forms the recesses 328 and the sprue hole 329 shown in FIG. 8. A conventionally operated plunger 330, (FIGS. 8 and 9) which is biased by means of springs 332, then ejects the compacted sand 326 of the cope and 334 of the drag onto a platform 336 which may then be lowered to a level of a takeoff conveyor (not shown). The platform 336 is raised and lowered by conventional means well known in the art, and is timed in a conventional manner to coact with the plunger 330.

The structure illustrated in FIGS. 11 and 12 represents an alternative embodiment of the present invention. Whereas in the embodiment described hereinabove, only a single form of mold was employed, the structure shown in FIGS. 11 and 12 is useful for rapidly interchanging the mold form. A plurality of first mold members 338 are formed on the upper surface of a plate 340 while a plurality of second form of mold members 342 is formed on the lower surface of the plate 340. When it is desired to change the production run from one form of mold member to another, the plate 340 is inverted by means of a pinion 344 that meshingly engages with a rack 346. A piston and air cylinder arrangement 348 is utilized for linearly reciprocating the rack 346. Relays 350, provided with pins or rods, are retractable in order to permit rotation of the plate 340 which initially rests on the pins, as best shown in FIG. 11. The relays 350 are operated in a conventional manner to coact with the air cylinder arrangement 348. As shown in FIGS. 2 and 3, both the mold form of the drag and the cope can be interchanged to provide matching molds.

The mode of operation of the present invention and the sequence of steps thereof may best be appreciated by reference to FIG. 1 which is a plan view. Using the longitudinal axis fo the central post 28 as the center, four angularly spaced apart stations should be visualized. The first and second stations are at the 12 and 6 o'clock positions, respectively, while the third and fourth stations are at the 9 and 3 o'clock positions, respectively. All of the stations are on the same pitch circle.

The first cope 172 and the first drag 128 are located at the 9 o'clock position and have already been filled with sand and compacted in the manner and using the apparatus described hereinabove. That is, the drag 128 has already been inverted and the first cope 172, which is superimposed over the first drag 128, has moved downwardly to assume the relationship shown in FIG. 6. The table 336 shown in FIGS. 8 and 9 has moved upwardly and the ram 330, which is shown in FIGS. 8 and 9 but which has been omitted for purposes of clarity from FIG. 1, is about to descend in order to eject the sand as a unit.

The second drag 128 is in the 12 o'clock position (FIG. 2) and is empty. The second cope 172 is in the 6 o'clock position and is also empty. With the openings 36 and 42 (66 and 72) of the housing 30 (32) in alignment, as shown in FIGS. 2, and with the openings 50 and 62 (84 and 92) misaligned, sand can be introduced into the annular chamber 58 (88) of the housing 30 (32). As mentioned hereinabove, before sand enters the funnel 94 (110), the cylinder and piston assembly 44, 46 (74, 76) will have rotated the upper closure member 38 (70) in order to misalign the openings 36 and 42 (66 and 72) and to simultaneously place the openings 50 and 62 (84 and 92) into alignment.

It should be further noted that in suitably timed relationship, the elevator 138 (186) will have moved upwardly via the action of the cylinder and piston assembly 140, 142 (188, 190) so that the impression forming members 170 (228) will be located within the drag 128 (cope 172, as shown in FIG. 3). When a sufficient quantity of sand has accumulated in the drag (cope 172), utilizing the air stream through the conduit 56 (86) for assistance, cylinder and piston assembly 102, 104 (112, 114) drive the ram 106 (116) downwardly in order to compact the sand. A similar sequence of steps occurs at the same time, utilizing the structures shown in FIGS. 2 and 3 in order to compact the sand in both the second cope 172 and drag 128.

At this time, the cylinder and piston assemblies 284, 288 and 286, 290 are actuated so that the second cope 172 and the second drag 128 are moved to the fourth station at the 3 o'clock position with the drag 128 being inverted during its arcuate travel. Simultaneously, the first cope 172 and the first drag 128, which has had the sand mold ejected therefrom as described previously, will travel, respectively, to the 6 o'clock and 12 o'clock positions, with the drag 128 being inverted back during its travel.

The sequence of operation may be repeated as many times as it is necessary with the pairs of copes and drags 172, 128 moving back and forth from the 6 o'clock and 12 o'clock positions to the 9 o'clock position, or from the 6 o'clock position and the 12 o'clock position to the 3 o'clock position. Thus, two parallel conveyor means at the 9 o'clock and 3 o'clock positions may be used to remove the finished sand molds.

It should be appreciated at this time that cores 280 may be inserted, as shown for example in FIG. 4, at those times when a cope 172 and a drag 128 are located at either the 3 o'clock position or the 9 o'clock position, and are vertically spaced apart. It should be further appreciated that at any time during the foregoing sequence of steps, the plate 340 carrying the impression forming means 338 and 342 may be inverted as shown in FIGS. 11 and 12 in order to form different sand molds.

It should also be appreciated that all the abovementioned air cylinders are conventional and well known in the art, being connected to conventional air hoses which are activated in a conventional manner. Furthermore, as mentioned above, the hollow tube 28 may be used as a central air supply receiving the air hoses from the various actuating means or drive assemblies mentioned above.

Numerous alterations of the structure herein disclosed will suggest themselves o those skilled in the art. However, it is to be understood that the present disclosure relates to a preferred embodiment of the invention which is for purposes of illustration only and is not to be construed as a limitation of the invention.

I claim:

1. Automatic sand mold fabricating apparatus comprising:

a. a first drag and a first cope;

b. first and second filling means defining first and second stations, respectively, for depositing a quantity of sand in said first drag and in said first cope;

c. first and second support means for positioning said first drag and said first cope in opposition to said first and said second filling means, respectively;

d. first and second impression forming means coopertively associated with said first drag and with said first cope at said first and said second stations, respectively;

e. first and second actuating means for reciprocatingly moving said first and second impression forming means, respectively, wherein complimentary recesses are formed in the sand in said first drag and in said first cope with said recesses facing in the same direction;

f. displacing means for reciprocatingly moving said first drag and said first cope to and from a common, third station whereby said first cope is superimposed over said first drag;

g. first rotating means for reciprocatingly inverting said first drag before said first drag reaches said third station and before said first drag returns to said first station whereby said recesses in said first cope and said first drag are in opposition to each other; and h. first ejection means for discharging the sand from said first cope and said first drag in the form of a mold at said third station.

2. An apparatus according to claim 1, wherein said first and said second stations are diametrically opposed to each other and on the same pitch circle, said third, common station being on said same pitch circle and angularly displaced 90° from said first an said second stations.

3. An apparatus according to claim 1, wherein said displacing means includes means for angularly reciprocating said first drag and said first cope.

4. An apparatus according to claim 3, including first and second mounting means independently mounting said first drag and said first cope on a common post that is central to said first and said second stations and wherein said displacing means comprises first and second oppositely acting drive means coupled to said mounting means.

5. An apparatus according to claim 4, wherein said mounting means for said first cope comprises a sleeve rotatably mounted on said post, support means connected to said sleeve for moving axially with respect to the longitudinal axis of said post, said support means being connected to said first cope for axially moving said first cope.

6. An apparatus according to claim 4, wherein said mounting means for sid first drag comprises a sleeve rotatably mounted on said post, means for moving said sleeve angularly with respect to the longitudinal axis of said post, and means for coupling said first drag to said means for angularly moving said sleeve.

7. Apparatus according to claim 6, wherein arcuate cam means are providing having portions thereof spaced axially with respect to the longitudinal axis of said post, cam follower means secured to said sleeve and arranged to traverse the length of said cam means, and switch means responsive to the movement of said cam follower means in the axial direction for actuating said first rotating means.

8. An apparatus according to claim 1, wherein said first cope is initially spaced apart from said first drag at said third station and wherein first inserting means are included for placing a core in the spaced apart confronting recesses in said first cope and said first drag.

9. An apparatus according to claim 8, wherein said first inserting means comprises a block, means for releasably holding the core in said block and reciprocating means for moving said block to a position intermediate said first cope and said first drag and for retracting said block after the core is placed in the confronting recesses in said first cope and said first drag.

10. An apparatus according to claim 8, wherein drive means are included for moving said first core into abutment with said first drag after the core is in place and after said block is retracted.

11. An apparatus according to claim 1, wherein said first and said second filling means each comprises a housing, first and second upper closure means each having a plurality of openings therethrough on a common pitch circle, said first upper closure means being rotatable relative to said second upper closure means, means for reciprocatingly moving said first upper closure means, first and second lower closure means each having a plurality of openings therethrough on the same pitch circle as said openings in said first and said second upper closure means, means for coupling said first upper closure means to said first lower closure means for concurrent displacement thereof whereby when said openings in said first and second upper closure means are in alignment and are arranged to permit introduction of sand into said housing, said openings in said first and second lower closure means are misaligned to thereby prevent flow of said therethrough and whereby when said openings in said first and second upper closure means are misaligned, said openings in said first and second lower closure means are aligned to thereby permit the flow of sand therethrough and into said first cope and said first drag at said first and said second stations, respectively.

12. An apparatus according to claim 11, wherein first and second funnel means are positioned intermediate each said housing and said first drag and said first cope, respectively, for receiving the sand flowing through said openings in said first and second lower closure means when said first and second lower closure means are aligned to thereby guide the sand into said first drag and said first cope.

13. An apparatus according to claim 11, wherein first and second ram means are included for compressing the sand in said first drag and said first cope, respectively.

14. An apparatus according to claim 11, wherein there is further included air injection means in said housing for assisting the flow of sand therethrough, said air injection means being operative only when said openings in said first and said second upper closure means are misaligned.

15. An apparatus according to claim 1, wherein said first ejection means comprises a reciprocable plunger means arranged to move linearly to thereby push the sand from said first cope and said first drag, and platform means for receiving the ejected sand.

16. An apparatus according to claim 1, wherein said first and second impression forming means comprises a plate, recess forming means having a first shape positioned on one surface of said plate, recess forming means having a second, different shape positioned on the opposite surface of said plate, and rotating means for selectively inverting said plate whereby either one of said recess forming means is in opposition to the sand in said first cope and said first drag.

17. An apparatus according to claim 2, wherein there is further included a fourch common station on the same pitch circle as said first, said second and said third stations, said fourth station being angularly displaced from said first and said second stations by 90° and wherein there is still further included:

a. a second drag and a second cope;

b. third and fourth supporting means for positioning said second drag and said cope in opposition to said first and said second filling means when said first cope and said first drag are at said third stations;

c. said first and said second impression forming means being adapted to be cooperatively associated with said second drag and with said second cope at said first and said second stations, respectively;

d. said first and said second actuating means adapted for reciprocatingly moving said first and second impression forming means, respectively, whereby complimentary recesses are formed in the sand in said second drag and in said second cope with said recesses facing in the same direction;

e. said displacing means being adapted for reciprocatingly moving said second drag and said second cope to and from said common fourth station whereby said second cope is superimposed over said second drag;

f. second rotating means for inverting said second drag before said second drag reaches said fourth station and before said second drag returns to said first station, whereby said recesses in said second cope and said second drag are in opposition to each other; and g. second ejection means for discharging the sand from said second drag and said second cope in the form of a mold at said fourth station.

18. An apparatus according to claim 17, wherein said displacing means includes means for angularly reciprocating said first and second drag and said first and second cope.

19. An apparatus according to claim 18, wherein there is a common post that is central to said first, said second, said third and said fourth stations and wherein said first mounting means carries said first and said second drags thereon as a unit and wherein said second mounting means carries said first and said second copes thereon as a unit, said first and said second mounting means being independent of each other.

20. An apparatus according to claim 19, wherein said first mounting means for said first and second copes comprises a sleeve rotatably mounted on said post, support means connected to said sleeve for moving axially with respect to the longitudinal axis of said post, said support means being connected to said first and second copes for axially moving said first and second copes independent of each other.

21. An apparatus according to claim 19, wherein said second mounting means for said first and second drags comprises a sleeve rotatably mounted on said post, means for moving said sleeve angularly with respect to said post, and means for coupling said first and said second drags to said means for angularly moving said sleeve.

22. An apparatus according to claim 21, wherein arcuate cam means are provided having portions thereof spaced apart axially with respect to the longitudinal axis of said post, cam follower means secured to said sleeve and arranged to traverse the length of said cam means, and switch means responsive to the movement of said cam follower means in the axial direction for actuating said first and second rotating means.

23. An apparatus according to claim 17, wherein said first and said second copes are initially spaced apart from their respective drags at said third and said fourth stations, respectively, and wherein first and second inserting means are included for placing a core in the confronting recesses in the cooperating and confronting ones of said first and second copes and said first and second drags.

24. An apparatus according to claim 23, wherein said first and said second inserting means each comprises a block means for releasably holding the core in said block and reciprocating means for moving said block from a position intermediate said respective cope and drag and for retracting said block after the core is placed in the confronting recesses in the cooperating core and drag.

25. An apparatus according to claim 23, wherein drive means are included for moving said first and said second cores into abutment with said first and said second drags, respectively, after the core is in place and after said blocks are retracted.

26. An apparatus according to claim 17, wherein said first and said second filling means each comprises a housing, first and second upper closure means each having a plurality of openings therethrough on a common pitch circle, said first upper closure means being rotatable relative to said second upper closure means, means for reciprocatingly moving said first upper closure means, first and second lower closure means each having a plurality of openings therethrough on the same pitch circle as said openings in said first and said second upper closure means, means for coupling said first upper closure means to said first lower closure means for concurrent displacement thereof whereby when said openings in said first and said second upper closure means are in alignment to thereby permit introduction of sand into said housing, said openings in said first and said second lower closure means are misaligned to thereby prevent flow of said therethrough and whereby when said openings in said first and said second upper closure means are misaligned, said openings in said first and said second lower closure means are aligned to thereby permit the flow of said therethrough and into said cope and said drag at said first an said second stations.

27. An apparatus according to claim 26, wherein first and second funnel means are positioned intermediate each said housing and said first drag and said first cope, respectively, for receiving the sand flowing through said first and said second lower closure means when said openings in said first and said second lower closure means are aligned for guiding sand into said drag and said cope positioned therebelow.

28. An apparatus according to claim 26, wherein first and second ram means are included for compressing the sand in each said drag and each said cope, respectively.

29. An apparatus according to claim 26, wherein there is further included air injection means in each said housing for assisting the flow of said therethrough, said air injection means being operative only when said openings in said first and said second upper closure means are misaligned.

30. An apparatus according to claim 17, wherein said first ejection means comprises a reciprocable plunger means arranged to move linearly to thereby push the sand from each said cope and each said drag, and platform means for receiving the ejected sand.

31. An apparatus according to claim 17, wherein said first and said second impression forming means comprises a plate, recess forming means having a first shape positioned one surface of said plate, said recess forming means having a second, different shape positioned on the opposite surface of said plate, and rotating means for selectively inverting said plate whereby either one of said recess forming means is in opposition to the sand in each said cope and each said drag.

* * * * *